US008684173B2

(12) United States Patent
Otsuka et al.

(10) Patent No.: US 8,684,173 B2
(45) Date of Patent: Apr. 1, 2014

(54) BEFORE-USE MIXING CONTAINER

(75) Inventors: Tadashi Otsuka, Hyogo (JP); Takashi Fujimoto, Toyama (JP)

(73) Assignee: Senju Pharmaceutical Co., Ltd., Osaka (JP)

( * ) Notice: Subject to any disclaimer, the term of this patent is extended or adjusted under 35 U.S.C. 154(b) by 379 days.

(21) Appl. No.: 13/260,486

(22) PCT Filed: Apr. 1, 2010

(86) PCT No.: PCT/JP2010/056029

§ 371 (c)(1),
(2), (4) Date: Sep. 26, 2011

(87) PCT Pub. No.: WO2010/114101

PCT Pub. Date: Oct. 7, 2010

(65) Prior Publication Data

US 2012/0024861 A1 Feb. 2, 2012

(30) Foreign Application Priority Data

Apr. 2, 2009 (JP) ..... 2009-090183

(51) Int. Cl.
*B65D 25/08* (2006.01)

(52) U.S. Cl.
USPC ..... 206/221; 206/219; 215/DIG. 8

(58) Field of Classification Search
USPC ..... 206/219, 220, 221, 222; 215/6, DIG. 8
See application file for complete search history.

(56) References Cited

U.S. PATENT DOCUMENTS

| | | | | |
|---|---|---|---|---|
| 5,794,802 | A * | 8/1998 | Caola | 215/11.1 |
| 6,994,211 | B2 * | 2/2006 | Cho | 206/221 |
| 7,740,134 | B2 * | 6/2010 | Sweeney et al. | 206/221 |

FOREIGN PATENT DOCUMENTS

| | | |
|---|---|---|
| JP | 05-146510 | 6/1993 |
| JP | 06-270969 | 9/1994 |
| JP | 3021279 | 11/1995 |
| JP | 10-059373 | 3/1998 |
| JP | 10-337321 | 12/1998 |
| JP | 11-267181 | 10/1999 |
| JP | 3228376 | 9/2001 |
| JP | 2003-292013 | 10/2003 |
| JP | 2005-187022 | 7/2005 |

OTHER PUBLICATIONS

International Search Report for PCT/JP2010/056029.
Written Opinion of the International Searching Authority for PCT/JP2010/056029.
International Preliminary Report on Patentability for PCT/JP2010/056029.
Official Action issued in corresponding Chinese Patent App. No. 201080015239.6 issued on Mar. 1, 2013.

* cited by examiner

*Primary Examiner* — Mickey Yu
*Assistant Examiner* — Chun Cheung
(74) *Attorney, Agent, or Firm* — Vedder Price P.C.

(57) ABSTRACT

The present invention provides a before-use mixing container in which it is possible to easily perform a mixing operation for two types of medicinal solutions and it is not until a mixing operation is performed that a medicinal solution is extracted for use from inside a container.

7 Claims, 5 Drawing Sheets

BEFORE-USE MIXING CONTAINER

TECHNICAL FIELD

The present invention relates to a before-use mixing container in which two types of medicinal solutions are stored in a separated state in one container, and these are mixed inside the container in use, and extracted for use.

BACKGROUND ART

There are many medicinal solutions such as eye drops, which are chemically unstable in a mixed state or a dissolved state, and in case of use of such a medicinal solution, it is necessary to perform a mixing operation immediately before use. There is a before-use mixing container as a container in which two types of medicinal solutions are stored in a separated state, and these are mixed in the container in use, and extracted for use.

As a before-use mixing container, for example, there has been known a container adopting a system that one medicinal solution and another medicinal solution are respectively contained in a first container body and a second container body in a separated state by use of isolation members in which one member having an opening portion and the other member having an opening portion are slidably fit into each other so that their opening portions do not face each other, and both opening portions are made to face each other by a sliding operation of the isolation members, to mix the two types of medicinal solutions (refer to Patent Documents 1 and 2).

PRIOR ART DOCUMENT

Patent Document

[Patent Document 1] Japanese Patent No. 3228376

[Patent Document 2] Japanese Published Unexamined Patent Application No. Hei-10-337321

SUMMARY OF THE INVENTION

Problems to be Solved by the Invention

However, since the before-use mixing container in Patent Document 1 is structured so that opening and closing processing of its cover body can be independently carried out and the before-use mixing container in Patent Document 2 is structured so that opening and closing processing of its cap body can be independently carried out respectively, there is a concern of an erroneous operation that only one medicinal solution is extracted due to an operation of opening the cover body or the cap body in advance of mixing of both medicinal solutions, and an operator actually carries out such an erroneous operation in some cases.

The present invention has been achieved in consideration of the above-described circumstances. It is a primary object of the present invention to provide a before-use mixing container in which it is possible to easily perform a mixing operation for two types of medicinal solutions in the container, and it is not until a mixing operation is performed that a medicinal solution is extracted for use.

Means for Solving the Problem

That is, the scope of the present invention is as follows.

A before-use mixing container including (1) an adapter having an apical wall, an outer tube installed vertically from the apical wall, and an inner tube capable of containing a medicinal solution therein, (2) a container main body having a mouth tube section fit at an outside of the outer tube of the adapter, to be assembled so as not to be rotatable with respect to the adapter, (3) a guide cap having a fit-in tube section into which the outer tube of the adapter is pressed to fit at an inside, to be assembled so as to be rotatable with respect to the adapter, (4) a cap mounted onto the guide cap so as to be freely removable, and a movable plug that tightly plugs a lower end opening portion of the inner tube of the adapter, in which the movable plug has an airtight-cap section for tightly plugging the lower end opening portion of the inner tube of the adapter, and an axial body which is extended upward from the airtight-cap section and is inserted through a rotation restricting hole for restricting a circumferential rotation, which is formed in the adapter, and in a state in which a leading end portion of the axial body brought into contact with an extracting hole formed in the guide cap, an end portion of the axial body is screwed in an axial body mounting section provided inside the guide cap.

[2] The before-use mixing container according to [1], in which the outer tube of the adapter has a large diameter section of a circular arc shape in plan view and a small diameter section, and in a state in which the outer tube of the adapter is pressed to fit at the inside of the fit-in tube section of the guide cap, the small diameter section of the adapter and the inner surface of the fit-in tube section of the guide cap are spaced from each other to generate a gap.

[3] The before-use mixing container according to [2], in which a protruding line with a height which is substantially the same as or lower than a spaced distance between the inner surface of the fit-in tube section and the small diameter section of the adapter is provided on an inner surface of the fit-in, tube section of the guide cap, and the protruding line faces the small diameter section of the adapter.

[4] The before-use mixing container according to any one of [1] to [3], in which the axial body of the movable plug has a rod-like bar axial body and a protruding line provided so as to protrude along the bar axial body, and the rotation restricting hole of the adapter is formed into a shape corresponding to a cross-sectional shape of the bar axial body and the protruding line.

[5] The before-use mixing container according to any one of [1] to [4], in which the axial body mounting section of the guide cap is configured so that the extracting hole is made to be communicated with an internal space of the guide cap when the guide cap is rotated in a direction in which the movable plug is screwed out, to slightly separate the leading end portion of the axial body of the movable plug from the extracting hole.

[6] The before-use mixing container according to any one of [1] to [5], in which the axial body mounting section of the guide cap is configured so that split tube parts in which screw portions screwed in the end portion of the axial body of the movable plug are carved on inner surfaces thereof so as to surround the extracting hole, are provided so as to droop from a lower surface of a ceiling wall of the guide cap in which the extracting hole is formed.

[7] The before-use mixing container according to any one of [1] to [6], in which the container main body is made of polypropylene (PP), the movable plug is made of at least one type selected from high-density polyethylene (HDPE), linear low-density polyethylene (LLDPE), low-density polyethylene (LDPE), and thermoplastic elastomer (TPE), the guide cap is made of at least one type selected from HDPE and PP, the adapter is made of at least one type selected from HDPE, LLDPE, and LDPE, and the cap is made of PP.

[8] A method for using a before-use mixing container which is configured so that the airtight-cap section of a movable plug having an axial body extended upward from an airtight-cap section is disposed at a boundary portion between a first container body in which a first medicinal solution is contained and a second container body in which a second medicinal solution is contained, to isolate the first medicinal solution and the second medicinal solution from each other, and an end portion of the axial body of the movable plug is screwed in an axial body mounting section formed inside an operational tube section separated from the first container body and the second container body, the method including, in a state in which the first container body, the second container body, and the movable plug are assembled so as not to be rotatable, relatively rotating the operational tube section in a direction in which the movable plug is screwed out, thereby releasing the isolated state of the airtight-cap section of the movable plug.

Effects of the Invention

According to the before-use mixing container of the present invention, since the container main body, the adapter, and the movable plug are assembled so as not to be relatively rotatable with respect to each other, the guide cap is assembled so as to be relatively rotatable with respect to these three members, and the leading portion of the axial body of the movable plug is brought into contact with the extracting hole, the medicinal solutions are not extracted in any case even when the cap is removed before the medicinal solutions are mixed. Then, since the two types of medicinal solutions are mixed by merely relatively rotating the guide cap in a direction in which the movable plug is screwed out, a mixing operation is easy. Moreover, since the state in which the leading end portion of the axial body is brought into contact with the extracting hole is released in a mixing operation, it is not until a mixing operation is performed that a medicinal solution is extracted, thereby preventing an erroneous operation that only one medicinal solution is extracted for use by mistake.

EMBODIMENT FOR CARRYING OUT THE INVENTION

Figure 1:
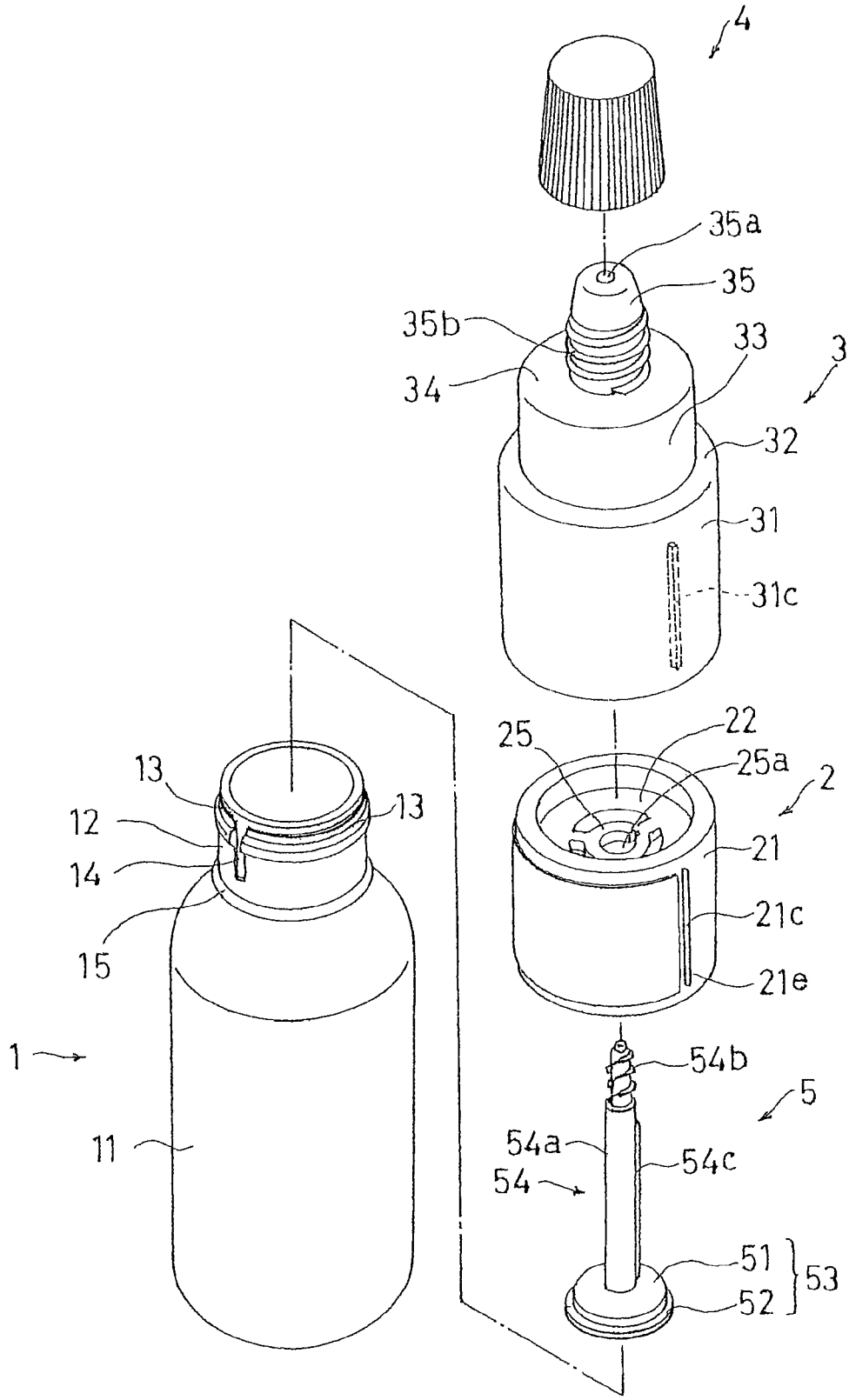
FIG. 1 is an exploded perspective view of a before-use mixing container showing an embodiment of the present invention.

Hereinafter, am embodiment of the present invention will be described with reference to the drawings. FIGS. 1 to 6 show the embodiment of the present invention. A before-use mixing container of the present invention is composed of a container main body 1, an adapter 2, a guide cap 3, a cap 4, and a movable plug 5, which are integrally assembled.

The container main body 1 is a blow molded part made of synthetic resin. A first medicinal solution A is contained in the container main body 1, and a mouth tube section 12 is consecutively installed upright via its shoulder portion on the upper end of a bottomed cylindrical body section 11 thereof. Two locking protruding lines 13 and 13 with a length which is approximately the half circle of the mouth tube section 12 are provided to protrude so as to go around the mouth tube section 12 on the outer surface of the mouth tube section 12, and longitudinal locking groove lines 14 are provided so as to be carved on the front surface side and the rear surface side with respect to the center of axis between the two locking protruding lines 13 and 13. Further, a peripheral protruding line 15 going around the mouth tube section 12 is provided so as to protrude on the outer surface of the lower portion of the mouth tube section 12.

The adapter 2 is an injection-molded part made of synthetic resin. The adapter 2 is composed of a cylindrical outer tube 21 which is fit at the outside of the mouth tube section 12 of the container main body 1, an apical wall 22 installed around so as to be an inner ledge shape inward in its radial direction from the inner surface of the upper portion of the outer tube 21, and a cylindrical inner tube 23 which is installed so as to droop from the inner circumferential end of the apical wall 22, and is tightly fit into the opening portion of the mouth tube section 12 of the container main body 1. A locking protruding line 24 locked with locking protruding lines 13 of the mouth tube section 12 of the container main body 1 in the axial line direction, is installed around the inner surface of the intermediate portion of the outer tube 21, and locking protruding lines (not shown) engaged with the locking groove lines 14 of the mouth tube section 12 of the container main body 1 are vertically provided so as to protrude on the front surface side and the rear surface side with respect to the center of axis in the inner surface of the outer tube 21. Further, in a state in which the adapter 2 and the container main body 1 are assembled together, the lower surface circumferential end portion of the apical wall 22 is tightly attached to the opening end surface of the mouth tube section 12 of the container main body 1. That is, the adapter 2 and the mouth tube section 12 of the container main body 1 are assembled in a liquid-tight manner and in the axial line direction so as not to be allowed to be detached due to the tight-attachment between the lower surface circumferential end portion of the apical call 22 and the opening end surface of the mouth tube section 12 of the container main body 1, and the locking in the axial line direction between the locking protruding line 24 on the inner surface of the outer tube 21 and the locking protruding lines 13 on the outer surface of the mouth tube section 12, and are assembled so as not to be rotatable due to the engagement in the radial direction between the locking protruding lines (not shown) on the inner surface of the outer tube 21 of the adapter 2 and the locking groove lines 14 in the mouth tube section 12.

A substantially circular movable plug holding section 25 in which a rotation restricting hole 25*a* through which the movable plug 5 is inserted is drilled, is formed to the central portion of the opening portion upper end of the inner tube 23, and the movable plug holding section 25 is connected to the apical wall 22 via three plate-like ribs 25*b* extended toward the center of axis from the inner circumferential end of the apical wall 22. Further, a second medicinal solution B is contained in the inner tube 23 whose lower end opening portion is tightly plugged with the movable plug 5.

The guide cap 3 is an injection-molded part made of synthetic resin. A ceiled cylindrical body section 33 is consecutively installed via a shoulder wall 32 installed around so as to be an inner ledge shape from the upper end of a cylindrical fit-in tube section 31 in which the outer tube 21 of the adapter 2 is pressed to fit at the inside thereof. A short cylindrical small diameter stage portion 31*a* is installed convexly on the inner surface of the upper end portion of the fit-in tube section 31, and a short cylindrical sealing inner tube 32*a* is installed in one plane with the inner surface of the body section 33 consecutively installed above it, so as to droop on the inner circumferential end of the shoulder wall 32, and a locking protruding line 31*b* is provided around on the inner surface of the lower end portion of the fit-in tube section 31. That is, with respect to the adapter 2 and the guide cap 3, in a state in which the outer tube 21 of the adapter 2 is pressed to fit at the inside of the fit-in tube section 31, the upper end portion of the outer tube 21 of the adapter 2 is tightly fit between the small diameter stage portion 31*a* of the fit-in tube section 31 and the sealing inner tube 32*a*, and the outer surface of the lower end portion of the outer tube 21 of the adapter 2 is locked in the axial line direction with the locking protruding line 31*b* of the fit-in tube section 31, in which the outer tube 21 of the adapter 2 and the fit-in tube section 31 are assembled in the axial line direction so as not to be allowed to be detached and to be relatively rotatable.

An extracting orifice 35*a* is provided in the apical portion of the upper surface of a ceiling wall 34 for blocking the opening portion of the body section 33 of the guide cap 3, and a nozzle section 35 provided with a screw portion 35*b* on its outer surface. The extracting orifice 35*a* is configured to have a cylindrical columnar depressed orifice wall from the apical portion of the nozzle section 35 up to the ceiling wall 34, and is made to be communicated with the internal space of the body section 33 through an extracting hole 35*c* drilled in the lower end of the extracting orifice 35*a* of the nozzle section 35 in the ceiling wall 34. Two split tube parts 36 and 36 in substantially circular arc shapes in section in which screw portions 36*a* are carved on their inner surfaces so as to surround the extracting hole 35*c*, are provided so as to droop and face each other on the lower surface of the ceiling wall 34, and the split tube parts 36 compose an axial body mounting section as a whole in which the axial body 54 of the movable plug 5 is screwed.

The cap 4 is composed of an apical wall 41, and a tube body 42 in a tapered cylindrical shape whose diameter is extended gently downward from the peripheral edge of the apical wall 41. A screw portion 42*a* screwed in the screw portion 35*b* of the nozzle section 35 of the guide cap 3 is provided on the inner surface of the tube body 42, and a convex portion 41*a* which is tightly attached to the opening edge of the extracting orifice 35*a* of the nozzle section is provided on the lower surface of the apical wall 41 in a liquid-tight manner.

The movable plug 5 is an injection-molded part made of synthetic resin. The movable plug 5 has a fit-in section 51 fit into the lower end opening portion of the inner tube 23 of the adapter 2, and an airtight-cap section 53 to which a partition wall 52 which is installed around to be an outer ledge shape from the lower edge of the fit-in section 51, to be tightly attached to the end face of the lower end opening of the inner tube 23 of the adapter 2 is consecutively installed, and has the axial body 54 extended upward from the upper surface of the fit-in section 51, to be inserted through the rotation restricting hole 25*a*. The axial body 54 has a screw portion 54*b* carved on the end portion of a rod-like bar axial body 54*a*, and has a protruding line 54*c* provided so as to protrude along the bar axial body 54*a*. In a state in which the leading end portion of the bar axial body 54*a* is brought into contact with the extracting hole 35*c* formed in the guide cap 3, the screw portion 54*b* is screwed in the screw portions 36*a* of the split tube parts 36 of the guide cap 3, and the axial body 54 is assembled with the guide cap 3. Further, the rotation restricting hole 25*a* is formed into a shape corresponding to a cross-sectional shape of the axial body 54 of the movable plug 5, and in a state in which the movable plug 5 is inserted through the rotation restricting hole 25*a* of the adapter 2 to be assembled with the split tube parts 36 of the guide cap 3, the movable plug 5 is restricted in its rotation in the circumferential direction by the rotation restricting hole 25*a*.

That is, the before-use mixing container of the present invention is configured so that the container main body 1, the adapter 2, the guide cap 3, the cap 4, and the movable plug 5 are integrally assembled, and by use of the airtight-cap section 53 of the movable plug 5 as a partition wall, a first medicinal solution A is contained in the container main body 1 and a second medicinal solution B is contained in inner tube 23 of the adapter 2. Then, regarding the possibility of rotation between the above-described respective members with each other, the container main body 1, the adapter 2, and the movable plug 5 are assembled so as not to be relatively rotatable with respect to each other, and the guide cap 3 is assembled so as to be relatively rotatable with respect to these three members.

In use of the before-use mixing container of the present invention, a mixing operation for the first medicinal solution A and the second medicinal solution B, and an extraction operation for a mixed liquid C are required. Regarding the former operation, the guide cap 3 is rotated in a direction in which the movable plug 5 is screwed out (in a counterclockwise direction viewed from above in FIG. 1) in a state of grasping the container main body 1. When the guide cap 3 is rotated, the split tube parts 36 are rotated along therewith, and the movable plug 5 is pushed down by a pitch of the screw portions 36*a* on the inner surface of the split tube parts 36 rotating according to the rotation. When the movable plug 5 is pushed down, the leading end portion of the axial body 54 of the movable plug 5 is separated from the extracting hole 35*c*, and the airtight-cap section 53 of the movable plug 5 as well is separated from the lower end opening portion of the inner tube 23 of the adapter 2. Therefore, the second medicinal solution B contained in the inner tube 23 of the adapter 2 falls into the container main body 1, thereby achieving mixing of the first medicinal solution A and the second medicinal solution B (refer to FIG. 3).

Next, at the time of extracting the mixed liquid C, the cap 4 is screwed out of the nozzle section 35, and the before-use mixing container is turned upside down. Then, the mixed liquid C passes through the apical wall 22 of the adapter 2, the movable plug holding section 25, and between the plate-like ribs 25*b* from the container main body 1, to reach the internal space of the guide cap 3. Moreover, since the space between the split tube part 36 and the split tube part 36 provided around the extracting hole 35*c* forms a liquid channel communicated with the extracting hole 35*c*, the mixed liquid C passes through the extracting hole 35*c* via this liquid channel to be extracted from the extracting hole 35*a* (refer to FIG. 4).

In the above-described embodiment, the two split tube parts 36 and 36 installed so as to droop to be disposed to face each other from the lower surface of the ceiling wall 34 of the guide cap 3, serve as an axial body mounting section. However, as long as the container is configured so that, when the leading end portion of the axial body 54 of the movable plug 5 is slightly separated from the extracting hole 35*c* by relatively rotating the guide cap 3 in a direction in which the movable plug 5 is screwed out, the extracting hole 35*c* is made to be communicated with the internal space of the guide cap 3, the mode of an axial body mounting section is not limited to the above-described embodiment.

Figure 2:
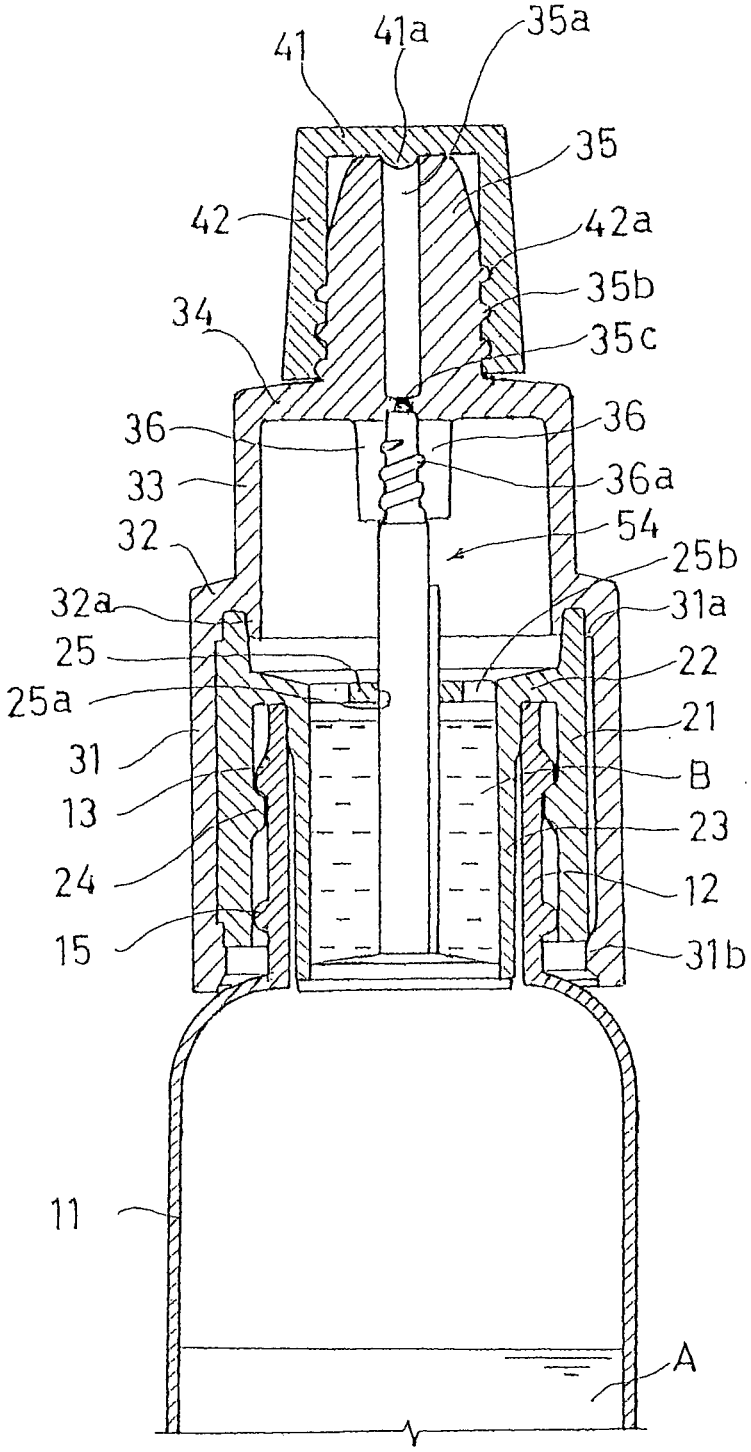
FIG. 2 is an enlarged sectional view of a principal part of the embodiment shown in FIG. 1.
Figure 3:
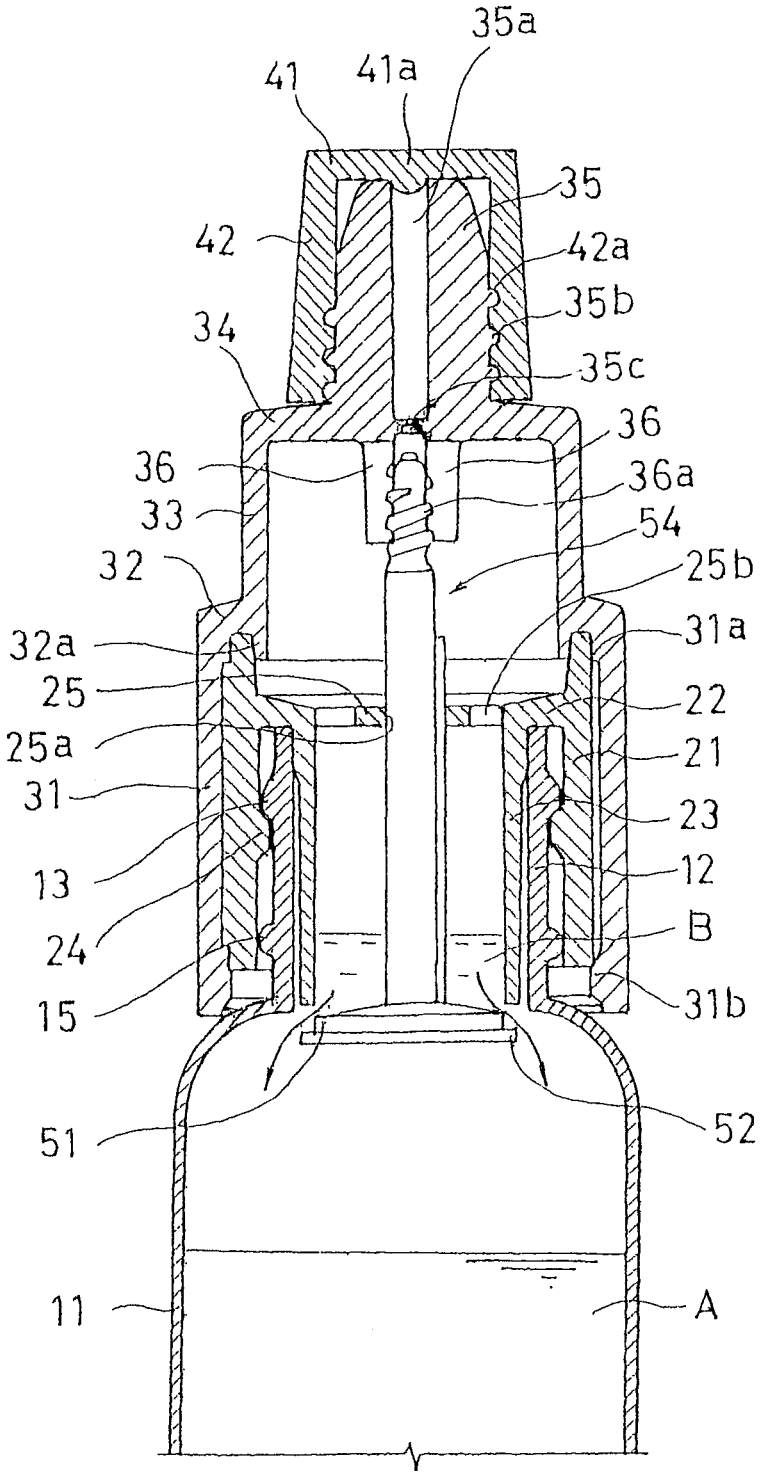
FIG. 3 is an explanatory diagram showing a state at the time of mixing two types of medicinal solutions.
Figure 4:
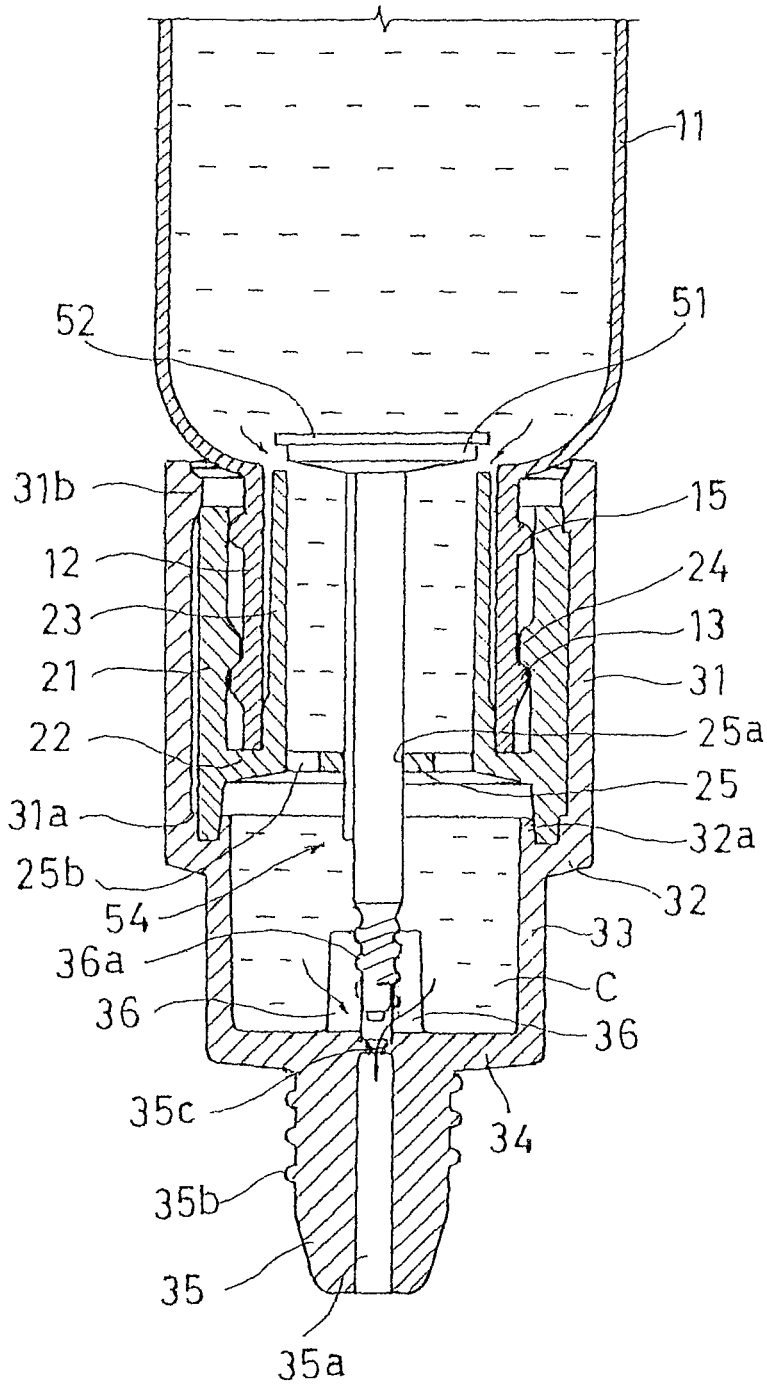
FIG. 4 is an explanatory diagram showing a state at the time of extracting a mixed medicinal solution.
Figure 5:
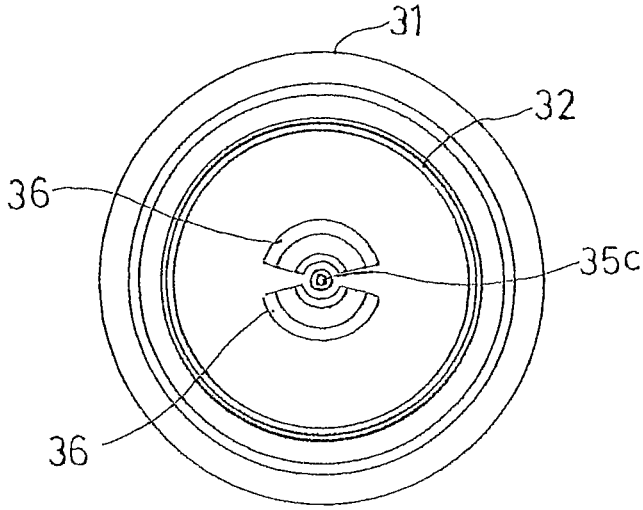
FIG. 5 is a diagram of a guide cap shown in FIGS. 1 to 4, that is viewed from the bottom.

In the present embodiment, the outer surface of the outer tube 21 of the adapter 2 is composed of a large diameter section 21*a* in a substantially circular arc shape in plan view and a small diameter section 21*b* (refer to FIGS. 1 and 6), and in a state in which the outer tube 21 is pressed to be fit at the inside of the fit-in tube section 31, the large diameter section 21*a* and the inner surface of the fit-in tube section 31 are tightly attached to one another, and the small diameter section 21*b* and the inner surface of the fit-in tube section 31 are spaced by a diameter of the small diameter stage portion 31*a* to generate a gap (refer to FIG. 2). Then, since the container is configured so that, at the time of mixing the first medicinal solution A and the second medicinal solution B, when the guide cap 3 is relatively rotated in a direction in which the movable plug 5 is screwed out in a state of grasping the container main body 1, the tightly-attached state between the large diameter section 21*a* and the inner surface of the fit-in tube section 31 is relaxed by a half circle distance of the outer tube 21, it is possible to rotate the fit-in tube section 31 with small turning force. Further, since it is possible to mix the first medicinal solution A and the second medicinal solution B by merely rotating the guide cap 3 by a predetermined angle from approximately 180 to 270 degrees, it is possible to easily perform a mixing operation.

Figure 6:
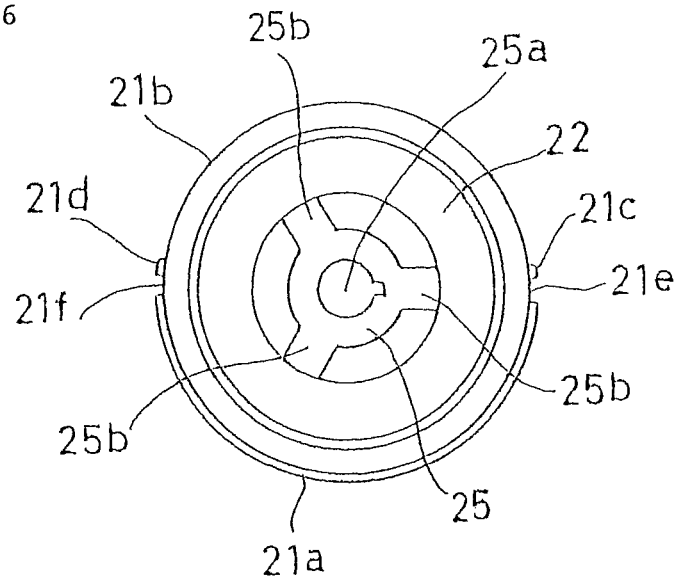
FIG. 6 is a diagram of an adapter shown in FIGS. 1 to 4, that is viewed from the top.

Further, in the present embodiment, protruding lines 21*c* and 21*d* are longitudinally provided respectively in the vicinity of one end side and in the vicinity of the other end side in the circumferential direction of the small diameter section 21*b* of the outer surface of the outer tube 21 of the adapter 2, and locking groove lines 21*e* and 21*f* are formed respectively between the protruding line 21*c* in the vicinity of the one end side in the circumferential direction of the small diameter section 21*b* and the other end side in the circumferential direction of the large diameter section 21*a* (the right end portion of the large diameter section 21*a* in FIG. 6), and between the protruding line 21*d* in the vicinity of the other end side in the circumferential direction of the small diameter section 21*b* and the one end side in the circumferential direction of the large diameter section 21*a* (the left end portion of the large diameter section 21*a* in FIG. 6). A locking protruding line 31*c* with a height which is the same as or lower than the spaced distance between it and the small diameter section 21*b* of the adapter 21*b* is longitudinally provided on the inner surface of the fit-in tube section 31 of the guide cap 3.

Then, at the time of pressing the outer tube 21 of the adapter 2 to fit at the inside of the fit-in tube section 31 of the guide cap 3 in manufacturing of the container, provided that the locking protruding line 31*c* on the inner surface of the fit-in tube section 31 is engaged with the locking groove line 21*e* of the adapter 2 corresponding to a rotation starting position to assemble the adapter 2 and the guide cap 3, it is easy to relatively rotate the guide cap 3 in a direction in which the locking protruding line 31*c* on the inner surface of the fit-in tube section 31 is made to climb over the protruding line 21*c* on the outer surface of the outer tube 21 of the adapter 2, which makes the movable plug 5 be screwed out (in a counterclockwise direction viewed from above in FIG. 1). On the other hand, since it is difficult to make the locking protruding line 31*c* on the inner surface of the fit-in tube section 31 climb over the large diameter section 21*a* of the outer surface of the outer tube 21 of the adapter 2 to relatively rotate, it is not easy to relatively rotate the guide cap 3 in a direction in which the movable plug 5 is screwed in. That is, since the large diameter section 21*a* and the small diameter section 21*b* of the outer surface of the outer tube 21 of the adapter 2, and the locking protruding line 31*c* on the inner surface of the fit-in tube section 31 of the guide cap 3 are provided, it is effectively prevented to relatively rotate the guide cap 3 in a direction in which the movable plug 5 is screwed in.

Further, provided that the locking protruding line 31*c* on the inner surface of the fit-in tube section 31 of the guide cap 3 is engaged with the locking groove line 21*f* corresponding to a rotation end position by relatively rotating the guide cap 3 by a predetermined angle from approximately 180 to 270 degrees in a direction in which the movable plug 5 is screwed out (in a counterclockwise direction viewed from above in FIG. 1), it is difficult to make the locking protruding line 31*c* on the inner surface of the fit-in tube section 31 climb over the large diameter section 21*a* of the outer surface of the outer tube 21 of the adapter 2 to relatively rotate, and therefore, it is not easy to further relatively rotate the guide cap 3. That is, since the large diameter section 21*a* and the small diameter section 21*b* of the outer surface of the outer tube 21 of the adapter 2, and the locking protruding line 31*c* on the inner surface of the fit-in tube section 31 of the guide cap 3 are provided, it is effectively prevented to relatively rotate the movable plug 5 more than necessary.

The before-use mixing container of the present invention is as follows from the standpoint of a mixing method. That is, a method for using a before-use mixing container which is configured so that, in the case in which the container main body 1, the inner tube 23 of the adapter 2, and the guide cap 3 respectively serve as a first container body, a second container body, and an operational tube section, the airtight-cap section 53 of the movable plug 5 having the axial body 54 extended upward from the airtight-cap section 53 is disposed at the boundary portion between the first container body 1 in which the first medicinal solution A is contained and the second container body 23 in which the second medicinal solution B is contained, to isolate the first medicinal solution A and the second medicinal solution B from each other, and the end portion of the axial body 54 of the movable plug 5 is screwed in the axial body mounting section formed inside the operational tube section 3, the method includes, in a state in which the first container body 1, the second container body 23, and the movable plug 5 are assembled so as not to be relatively rotatable with respect to each other, relatively rotating the operational tube section 3 in a direction in which the movable plug 5 is screwed out, thereby releasing the isolated state of the airtight-cap section 53 of the movable plug 5, and the mixing of the first medicinal solution A and the second medicinal solution B is achieved.

The synthetic resins used for the above-described respective members are not particularly limited in type. For example, low-density polyethylene (LDPE), linear low-density polyethylene (LLDPE), high-density polyethylene (HDPE), polypropylene (PP), thermoplastic elastomer (TPE), and the like may be appropriately combined for use. That is, the types of synthetic resins used for the respective members may be appropriately combined for any purpose. Further, with respect to synthetic resin used for one member, for example, in the case in which an integrally molded member is used, one type of synthetic resin is usually used for the member. However, in the case in which a plurality of components are separately manufactured, and members integrated by means that those components are assembled, thermally adhered to one another, or the like are used, a different type of synthetic resin may be used for each component.

In particular, in order to improve the liquid-tight performance between the respective members, it is preferable that PP which is generally used in the technical field according to the present invention, is used for the container main body 1 and the cap 4. Further, in order to improve the liquid-tight performance between the adapter 2 and the guide cap 3, a combination that LDPE is used for the adapter 2 and HDPE is used for the guide cap 3, and a combination that HDPE or LLDPE is used for the adapter 2 and PP is used for the guide cap 3, and the like are preferable. Moreover, in order to improve the liquid-tight performance between the adapter 2 and the movable plug 5, a combination that LDPE is used for the adapter 2 and LLDPE is used for the movable plug 5, a combination that HDPE is used for the adapter 2 and LLDPE or HDPE is used for the movable plug 5, and a combination that LLDPE is used for the adapter 2 and LDPE or TPE is used for the movable plug 5, and the like are preferable.

As a result of study by the present inventors, a combination of synthetic resins in which the liquid-tight performance between the respective members is maximized is, from a comprehensive point of view, in the case in which PP is used for the container main body 1, at least one type selected from HDPE, LLDPE and LDPE is used for the adapter 2, at least one type selected from HDPE and PP is used for the guide cap 3, PP is used for the cap 4, and at least one type selected from HDPE, LLDPE, LDPE, and TPE is used for the movable plug 5. Among the combinations of synthetic resins described above, it is preferable that the container main body 1 is PP, the adapter 2 is LLDPE, the guide cap 3 is PP, the cap 4 is PP, and the movable plug 5 is TPE. Moreover, it is preferable that the movable plug 5 is composed of the airtight-cap section 53 made of TPE and the axial body 54 made of HDPE which are integrated. As TPE, for example, TPE of styrene series, vinyl chloride series, olefin series, urethane series, polyester series, polyamide series, and the like are cited. Among those, in the case of using the movable plug 5 in which the airtight-cap section 53 made of TPE and the axial body 54 made of HDPE are thermally adhered to be integrated, TPE of styrene series is preferable as TPE. Further, in the case in which it is necessary to visually confirm a mixing operation, it is preferable that PP is used for the guide cap 3 and HDPE is used for the adapter 2.

[Embodiment]

The components of the container of the present invention were manufactured by use of synthetic resins shown in Table 1, test samples (A to K) in which the container main bodies and their inner tubes filled with medicinal solutions were assembled into products were prepared, and the liquid-tight performance between the respective components of these test samples (A to J) were evaluated. The evaluations of the liquid-tight performance were carried out so that the test samples were overturned to be left in a state in which normal pressure was reduced by 70 kPa, and after the pressure was returned to normal pressure ten minutes later, it was visually confirmed whether there was liquid leakage from the gaps between the fitting portions of the respective components. In addition, the test samples having shapes according to those in FIGS. 1 to 6, and in which its total height is 100 mm and the diameter of the body section of the container main body is 24 mm were used. The results are shown in Table 2. From the results in Table 1 and Table 2, it was understood that the test samples C, E, I, and G are excellent in liquid-tight performance between the respective components as compared with the other test samples from a comprehensive point of view.

TABLE 1

| Test sample | Container main body | Movable plug | Guide cap | Adapter | Cap |
|---|---|---|---|---|---|
| A | PP | LLDPE | PP | LDPE | PP |
| B | PP | HDPE | PP | LDPE | PP |
| C | PP | LLDPE | HDPE | LDPE | PP |
| D | PP | HDPE | HDPE | LDPE | PP |
| E | PP | LLDPE | PP | HDPE | PP |
| F | PP | HDPE | PP | HDPE | PP |
| G | PP | LLDPE | HDPE | HDPE | PP |
| H | PP | HDPE | HDPE | HDPE | PP |
| I | PP | LDPE | PP | LLDPE | PP |
| J | PP | TPE | PP | LLDPE | PP |
| K | PP | HDPE/TPE*a) | PP | LLDPE | PP |

PP: Polypropylene
LLDPE: Linear low-density polyethylene
HDPE: High-density polyethylene
LDPE: Low-density polyethylene
TPE: Thermoplastic elastomer
*a)HDPE is used for axial body and TPE is used for airtight-cap section respectively.

TABLE 2

| Test sample | Container main body Adapter | Adapter Movable plug | Adapter Guide cap | Guide cap Cap | Guide cap Movable plug |
|---|---|---|---|---|---|
| A | ▲ | x | x | ○ | ○ |
| B | ○ | x | x | ○ | x |
| C | ▲ | ○ | ○ | ○ | ○ |
| D | ○ | x | ○ | ○ | x |
| E | ○ | ○ | ▲ | ○ | ○ |
| F | ○ | ○ | x | ○ | ○ |
| G | ○ | x | x | ○ | ○ |
| H | x | x | x | ○ | ○ |
| I | ○ | ▲ | ○ | ○ | ○ |
| J | ○ | ○ | ○ | ○ | ○ |

○: No leakage,
▲: Slight exudation,
x: Leakage

Industrial Applicability

The present invention may have broad applicability as a before-use mixing container in which it is possible to easily perform a mixing operation for two types of medicinal solutions and it is not until a mixing operation is performed that a medicinal solution is extracted for use.

[Description of Reference Numerals]

| | |
|---|---|
| 1 | Container main body |
| 2 | Adapter |
| 3 | Guide cap |
| 4 | Cap |
| 5 | Movable plug |
| 12 | Mouth tube section |
| 21 | Outer tube |
| 21a | Large diameter section |
| 21b | Small diameter section |
| 22 | Apical wall |
| 23 | Inner tube |
| 25a | Rotation restricting hole |
| 31 | Fit-in tube section |
| 31c | Protruding line |
| 34 | Ceiling wall |
| 35c | Extracting hole |
| 36 | Split tube part |
| 36a | Screw portion |
| 53 | Airtight-cap section |
| 54 | Axial body |
| 54a | Bar axial body |
| 54c | Protruding line |

-continued

| [Description of Reference Numerals] | |
|---|---|
| A | First medicinal solution |
| B | Second medicinal solution |
| C | Mixed liquid |

The invention claimed is:

1. A before-use mixing container comprising:

(1) an adapter having an apical wall, an outer tube installed vertically from the apical wall, and an inner tube capable of containing a medicinal solution therein;

(2) a container main body having a mouth tube section fit at an inside of the outer tube of the adapter, to be assembled so as not to be rotatable with respect to the adapter;

(3) a guide cap having a fit-in tube section into which the outer tube of the adapter is pressed to fit at an inside, to be assembled so as to be rotatable with respect to the adapter;

(4) a cap mounted onto the guide cap so as to be freely removable; and a movable plug that tightly plugs a lower end opening portion of the inner tube of the adapter, wherein the movable plug has an airtight-cap section for tightly plugging the lower end opening portion of the inner tube of the adapter, and an axial body which is extended upward from the airtight-cap section and is inserted through a rotation restricting hole for restricting a circumferential rotation, which is formed in the adapter, and moreover, in a state in which a leading end portion of the axial body is brought into contact with an extracting hole formed in the guide cap, an end portion of the axial body is screwed in an axial body mounting section provided inside the guide cap.

2. The before-use mixing container according to claim 1, wherein the outer tube of the adapter has a large diameter section of a circular arc shape in plan view and a small diameter section, and in a state in which the outer tube of the adapter is pressed to fit at the inside of the fit-in tube section of the guide cap, the small diameter section of the adapter and the inner surface of the fit-in tube section of the guide cap are spaced from each other to generate a gap.

3. The before-use mixing container according to claim 2, wherein a protruding line with a height which is substantially the same as or lower than a spaced distance between the inner surface of the fit-in tube section and the small diameter section of the adapter is provided on an inner surface of the fit-in tube section of the guide cap, and the protruding line faces the small diameter section of the adapter.

4. The before-use mixing container according to claim 1, wherein the axial body of the movable plug has a rod-like bar axial body and a protruding line provided so as to protrude along the bar axial body, and the rotation restricting hole of the adapter is formed into a shape corresponding to a cross-sectional shape of the bar axial body and the protruding line.

5. The before-use mixing container according to claim 1, wherein the axial body mounting section of the guide cap is configured so that the extracting hole is made to be communicated with an internal space of the guide cap when the guide cap is rotated in a direction in which the movable plug is screwed out, to slightly separate the leading end portion of the axial body of the movable plug from the extracting hole.

6. The before-use mixing container according to claim 1, wherein the axial body mounting section of the guide cap is configured so that split tube parts in which screw portions screwed in the end portion of the axial body of the movable plug are carved on inner surfaces thereof so as to surround the extracting hole, are provided so as to droop from a lower surface of a ceiling wall of the guide cap in which the extracting hole is formed.

7. The before-use mixing container according to claim 1, wherein the container main body is made of polypropylene (PP), the movable plug is made of high-density polyethylene (HDPE), linear low-density polyethylene (LLDPE), low-density polyethylene (LDPE), or thermoplastic elastomer (TPE), the guide cap is made of HDPE or PP, the adapter is made of HDPE, LLPE, or LDPE, and the cap is made of PP.

* * * * *